US009401541B2

(12) United States Patent
Conwell

(10) Patent No.: US 9,401,541 B2
(45) Date of Patent: Jul. 26, 2016

(54) METHODS AND SYSTEMS USEFUL IN CONNECTION WITH MULTIPATH

(71) Applicant: Digimarc Corporation, Beaverton, OR (US)

(72) Inventor: William Y. Conwell, Portland, OR (US)

(73) Assignee: Digimarc Corporation, Beaverton, OR (US)

( * ) Notice: Subject to any disclaimer, the term of this patent is extended or adjusted under 35 U.S.C. 154(b) by 594 days.

(21) Appl. No.: 13/856,906

(22) Filed: Apr. 4, 2013

(65) Prior Publication Data

US 2013/0265196 A1 Oct. 10, 2013

Related U.S. Application Data

(60) Provisional application No. 61/621,248, filed on Apr. 6, 2012.

(51) Int. Cl.

| | |
|---|---|
| ***H01Q 3/34*** | (2006.01) |
| ***H01Q 1/24*** | (2006.01) |
| ***H01Q 3/24*** | (2006.01) |

(52) U.S. Cl.

CPC ..... *H01Q 3/34* (2013.01); *H01Q 1/246* (2013.01); *H01Q 3/24* (2013.01)

(58) Field of Classification Search

CPC ..... H01Q 3/34; H01Q 3/24
USPC ..... 342/372
See application file for complete search history.

(56) References Cited

U.S. PATENT DOCUMENTS

| | | | | |
|---|---|---|---|---|
| 7,333,532 | B2 | 2/2008 | Schultz-Rittich | |
| 7,515,916 | B1 * | 4/2009 | Alexander | H04W 24/08 345/582 |
| 7,599,426 | B2 | 10/2009 | Despain | |
| 7,876,266 | B2 | 1/2011 | Rhoads | |
| 7,983,185 | B2 | 7/2011 | Brunk | |
| 8,107,519 | B2 | 1/2012 | Kawauchi | |
| 8,107,572 | B1 | 1/2012 | Padalino | |
| 8,213,978 | B1 * | 7/2012 | Ho | H04W 24/02 370/227 |
| 2002/0172269 | A1 * | 11/2002 | Xu | H04L 1/02 375/211 |
| 2005/0192024 | A1 * | 9/2005 | Sheynblat | G01S 5/0263 455/456.1 |
| 2009/0213828 | A1 | 8/2009 | Brundage | |
| 2009/0233621 | A1 | 9/2009 | Brunk | |
| 2010/0148961 | A1 * | 6/2010 | Raphaeli | G01S 5/0289 340/552 |
| 2011/0110340 | A1 * | 5/2011 | Lakkis | H04W 74/08 370/336 |
| 2012/0309414 | A1 | 12/2012 | Rhoads | |
| 2012/0309415 | A1 * | 12/2012 | Rhoads | G01S 5/0273 455/456.1 |
| 2013/0316728 | A1 | 11/2013 | Bradley | |

* cited by examiner

*Primary Examiner* — Peter Bythrow
*Assistant Examiner* — Helena Seraydaryan
(74) *Attorney, Agent, or Firm* — Digimarc Corporation

(57) ABSTRACT

In accordance with one aspect of the present technology, information about multipath in an area is gained by occasionally switching the directivity of one or more of the involved antennas (transmitting or receiving). Based on resulting changes in signal strength, information about the multipath effects can be discerned, and corresponding action may thereafter be taken. Another aspect of the technology involves localizing sources of multipath by reference to multiple receiving stations, such as cellular receivers at cell towers in adjoining cells of a wireless network.

9 Claims, 5 Drawing Sheets

METHODS AND SYSTEMS USEFUL IN CONNECTION WITH MULTIPATH

RELATED APPLICATION DATA

This application claims priority to provisional application 61/621,248, filed Apr. 6, 2012.

BACKGROUND AND INTRODUCTION

The present disclosure is useful in connection with technology described in U.S. Pat. Nos. 7,876,266 and 7,983,185; published U.S. Patent Applications 20090233621 and 20090213828; and pending U.S. patent application Ser. No. 13/187,723, filed Jul. 21, 2011 (now published as 20120309415), Ser. No. 13/179,807, filed Jul. 11, 2011 (now published as 20120309414), and 61/613,915, filed Mar. 21, 2012 ("the previous patent work"). The disclosures of these documents are incorporated herein by reference, in their entireties.

In one respect, the previous patent work concerns accurately determining the position of wireless devices despite multipath propagation. That work generally assumes the directivity of the transmitting and receiving radiators is static over time (e.g., omnidirectional).

In accordance with one aspect of the present technology, insight into the structure of multipath cacophony is gained by occasionally switching the directivity of one or more of the antennas (transmitting or receiving). Based on resulting changes in signal strength, information about the multipath effects can be discerned, and corresponding action can be taken.

The foregoing and additional features and advantages of the present technology will be more readily apparent from the following detailed description, which proceeds with reference to the accompanying drawings.

DETAILED DESCRIPTION

Figure 1:
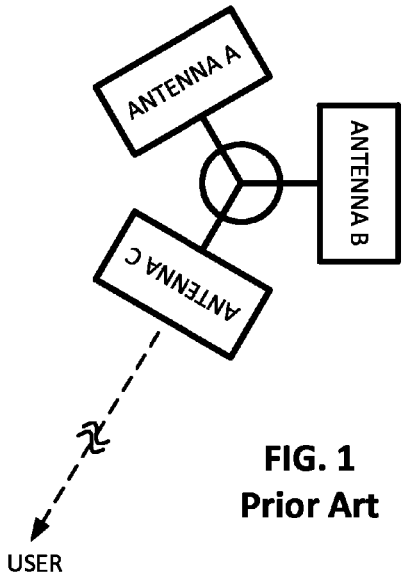
FIG. 1 Prior Art
FIG. 1 shows a view looking down on an antenna array used at a cell phone tower.
Figure 2:
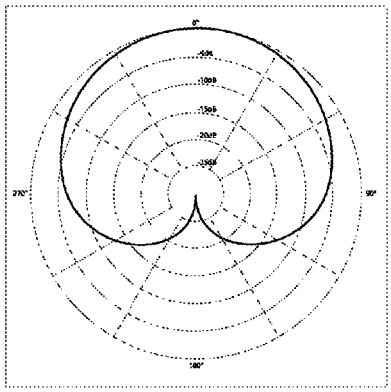
FIG. 2 Prior Art
FIG. 2 shows a cardioid directivity pattern.

An exemplary cell phone tower employs an antenna array comprising three identical antennas spaced 120 degrees around a supporting mast or tower. These are labeled Antennas A, B and C in FIG. 1. Each antenna has a somewhat directional pattern out from the tower. This is due in part to reflection from the tower, and may also be due to directivity inherent in the design of the component antennas (e.g., each antenna may comprise a two element vertically polarized yagi). A cardioid directivity pattern is exemplary. FIG. 2 shows such a cardioid pattern for Antenna A. In the aggregate, the cardioid patterns from the three antennas combine to yield a generally omnidirectional pattern in the horizontal plane for the antenna array as a whole.

Due to the directivity of the individual antennas A, B, C, a user in a particular direction from the cell phone tower will typically exchange signal energy primarily through one of the three antennas. In the FIG. 1 example, the user communicates primarily through Antenna C. Generally speaking, a user's cell phone exchanges energy primarily with the antenna on the "user's side" of the tower.

Figure 3A:
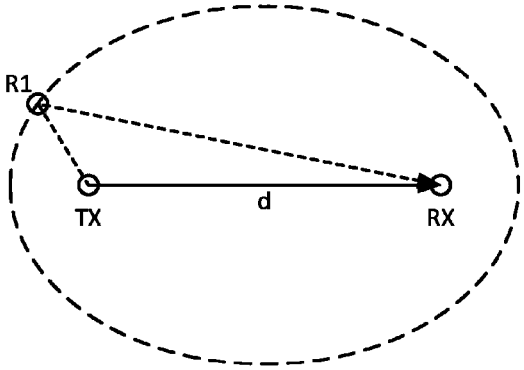
FIG. 3A Prior Art
FIGS. 3A and 3B illustrate how signals can travel from a transmitter to a receiver along different paths.
Figure 3B:
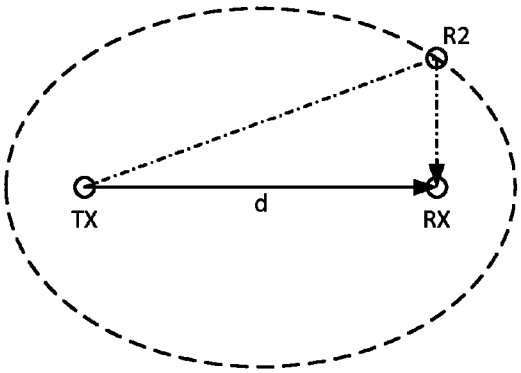
FIG. 3B Prior Art

FIGS. 3A and 3B depict multipath phenomena. (Multipath is detailed more fully in the previous patent work.) A transmitter (TX) and a receiver (RX) are separated by a distance "d." Radio waves between the transmitter and receiver typically travel directly between the two locations. However, the radio signals may also take indirect paths, such as via reflections off objects R1 (FIG. 3A) and R2 (FIG. 3B). These paths are longer than path "d." Such a path contributes an echo of sorts to the received signal.

Figure 4:
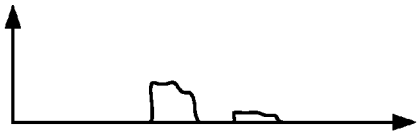
FIG. 4 Prior Art
FIG. 4 shows a plot of received signal strength versus time, indicating initial reception of a direct-path signal, followed by reception of a reflected (multipath) signal.

This is illustrated by FIG. 4, which shows the amplitude of a signal received at the receiver (RX) as a function of time. The origin of the graph is the time instant when a signal is first sent by the transmitter. No signal is received for a period of time while the transmitted signal is propagating directly from the transmitter antenna. Then it appears. Its time of onset is proportional to the direct distance "d" from the transmitter. A short time later, the multipath signal—which travels a greater distance—is received. Again, its time of onset is proportional to the longer length of the multipath route. The multipath signal is usually weaker in strength than the direct-path signal, although this is not always the case.

Returning to FIGS. 3A and 3B, if two reflecting objects R1 and R2 are positioned on an ellipse having the TX and RX at its foci, then these two longer paths each have same length.

From analysis of a signal at the receiver (RX), it is typically not possible to discern the location of an object that is causing multipath. From the time delay between reception of the direct signal (the first to be received) and the multipath signal, it is possible to identify the ellipse on which the reflecting object is positioned, but it is not possible to distinguish whether that reflecting object is at, e.g., location R1 or R2. The delay of the multipath signal is the same in both cases.

In accordance with one aspect of the present technology, control circuitry (FIG. 6) at the cell tower occasionally disables one or two of the three transmitting antennas. This changing of directivity of the tower's antenna array changes the multipath effects on signals received at the receiver (RX). By analyzing the received signals under different TX antenna system directivity conditions, the clutter of multipath can be decomposed into more tractable form.

Figure 5:
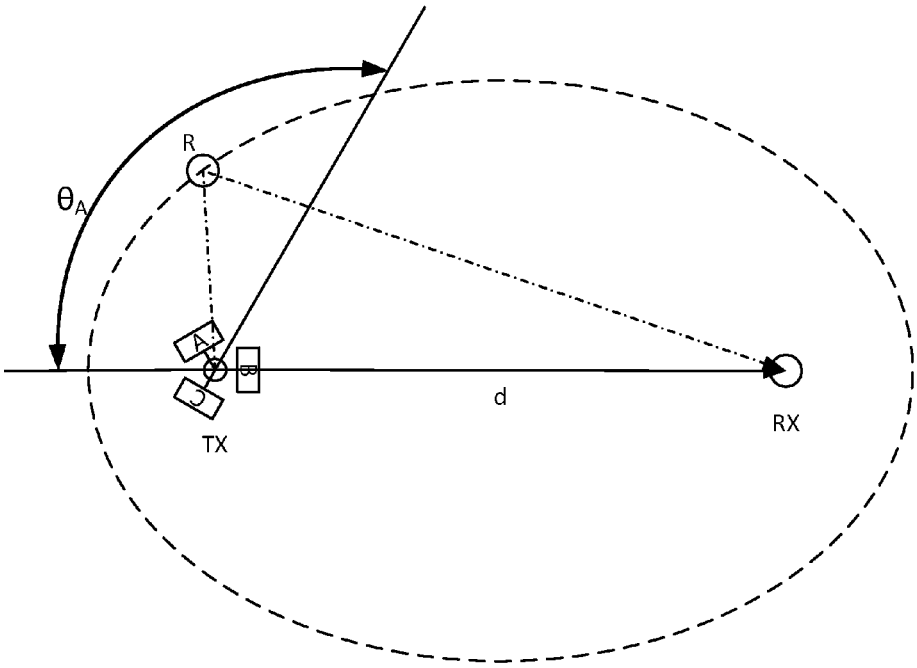
FIG. 5 is similar to FIGS. 3A and 3B, but incorporates a transmitting antenna with switchable directivity.
Figure 6:
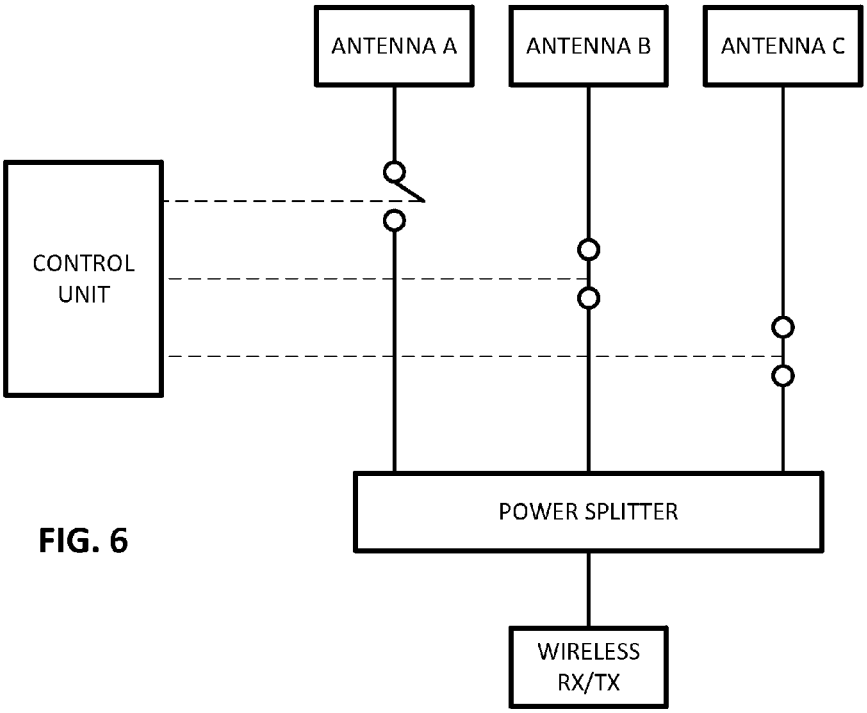
FIG. 6 shows an illustrative implementation incorporating certain aspects of the present technology.

Consider FIG. 5. The switching network of FIG. 6 is employed to momentarily disable antenna A, then antenna B, and then antenna C, in cyclical fashion. An object R that is contributing a multipath signal to the receiver (RX) is within the area primarily served by antenna A. When antenna A is momentarily disabled, the receiver detects that the multipath component of the received signal is minimized. From this fact the receiver discerns that the reflecting object R lies in the angular area $\theta_A$ (120 degrees) served by antenna A.

In another arrangement, rather than disabling one antenna at a time, the FIG. 6 arrangement is employed to disable two antennas at a time. In other words, only one of the three antennas is active during such intervals of the system's operation. The receiver will discover that, during the interval that antenna A, alone, is being operated, the delayed multipath component has its greatest strength. Again, this fact indicates that the multipath reflection comes from within the angular area $\theta_A$ served by antenna A.

Put another way, the multipath reflector R is illuminated most strongly by antenna A, due to the directivity of antenna A. If that radiator, alone, is momentarily active, the delayed energy from the multipath reflector R will increase relative to the direct, line-of-sight signal. If that radiator, alone, is momentarily idle, the delayed energy from the multipath reflector R will decrease relative to the direct, line-of-sight signal. The change in the multipath signal gives information about the location of the implicated reflector. This information allows a model of the multipath model to be refined, and more appropriate redress to be applied.

Of course, momentarily disabling one or more of the antennas causes a momentary drop in signals exchanged with one or more of the users. In digital systems, error correcting coding schemes allow these users' phones to recover any lost data bits. (Alternatively, the disabling can occur when no critical data is being exchanged with a user's phone, e.g., when the phone simply wakes up to see if it there is any signal to receive.)

In the just-discussed arrangement, the sensing of signal strength is done by the user's receiver (RX). This receiver may not have knowledge of which antenna configuration corresponds to which instant of time. It may simply note the signal levels (or the signal ratios—multipath-to-direct, or the signal to noise ratios) at different times, and report this information to a remote station (e.g., at the cell transmitter site). A processor at the remote station can then incorporate this information into a model of the multipath environment.

In a particular embodiment, a single antenna is disabled for 100 ms at the start of every minute: first antenna A, followed by antenna B and antenna C. The data sensed by the cell phone receiver in these 300 milliseconds is processed to provide information about the location of multipath re-radiators.

In the just described arrangement, there are four different TX antenna states: all transmitting (A+B+C), A+B, B+C and A+C. In other arrangements, up to seven different states may be analyzed, depending on different combinations of antenna excitation among the three antennas: A+B+C, A, B, C, A+B, A+C, and B+C.

While described in the context of varying the pattern of signal transmitted from the cell tower, a similar arrangement varies the pattern of signal received at the cell tower. Consider a cell tower equipped with six antennas—three for transmitting to the cell phones, and three for listening to the cell phones. The former set can be used as described above. Alternatively or additionally, the latter set can be used. That is, at intervals, the pattern of the receiving antenna array is altered to sense variations in multipath effects on signals received from users' cell phones. Again, a multipath re-radiator can thereby be localized as falling within one of three geographical service areas, corresponding to the directivity of the component receiving antennas.

The same concept can be applied reciprocally in a portable device—periodically changing directivity of its antenna system. This can be done using a passive, parasitic element whose electrical length is changed by operating one or more PIN or varactor diodes to insert one or more different reactances into, or otherwise alter, the parasitic element circuit—thereby changing its electrical length, with consequent changes in directivity of the antenna system.

Figure 7:
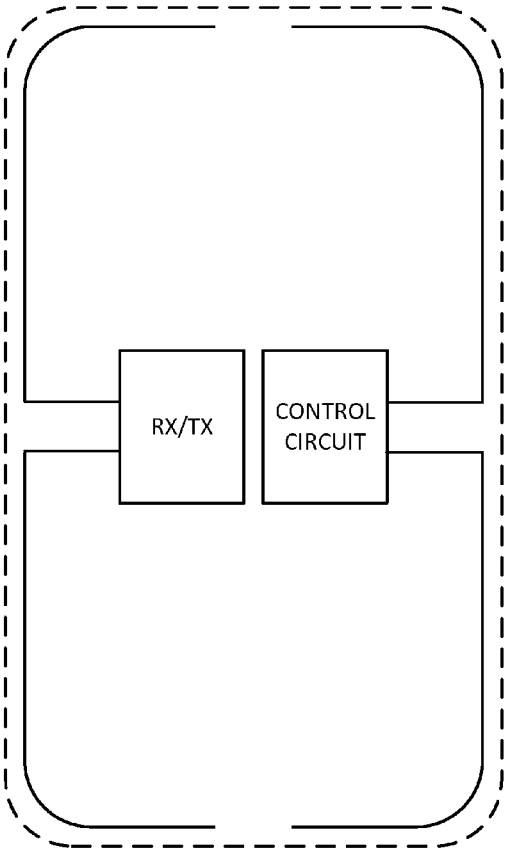
FIG. 7 shows an illustrative parasitic antenna array in a cell phone body.

Such an arrangement is shown in FIG. 7. An electrical conductor is disposed around the left edge of a smartphone body, and serves as the primary, driven antenna—coupled to transmitter and receiver circuits. One the opposite, right edge of the smartphone body is a parasitic element. A control circuit uses one or more diodes to change the electrical length of the right element, such as introducing a lumped circuit capacitive or inductive element, or introducing/bypassing stripline transmission line elements. If the electrical length of the parasitic element is made shorter than the driven element, directivity towards the right is enhanced, and if the electrical length of the parasitic element is made longer than the driven element, directivity towards the left is enhanced.

(It will be recognized that in other arrangements, mobile device antenna elements are not center-fed, but are rather end-fed, or offset-fed. The same principles, however, nonetheless apply.)

Figure 7A:
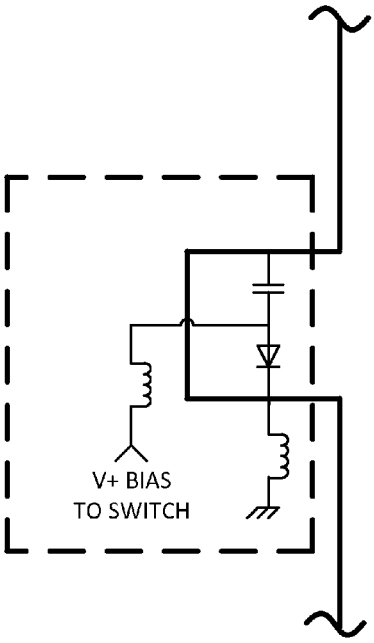
FIG. 7A shows an illustrative control circuit for the antenna array of FIG. 6.

An illustrative control circuit is shown in FIG. 7A. A PIN diode is controllably biased into a conductive state by application of a control voltage. When the diode is conductive, it serves to shorten the parasitic element by further-shortening a shorted stub.

In the case of controlling directivity of the portable device antenna system, the absolute directivity at any given instant will be a function of the pose of the device. Accordingly, 3D magnetometer or gyroscopic data, or the like, should be sampled from corresponding sensors in the device, and the resulting pose/directivity information should be figured into the analysis, i.e., to indicate the absolute directivity—such as in the geometrical reference system that includes the cell site transmitter at its origin, with "vertical" being the direction parallel to the cell site tower.

Still richer environmental data can be gathered by switching the directivity of both the cell site antenna and the user device antenna—thereby probing the configuration of relevant reflectors using the data from both ends of the radio circuit.

Figure 8:
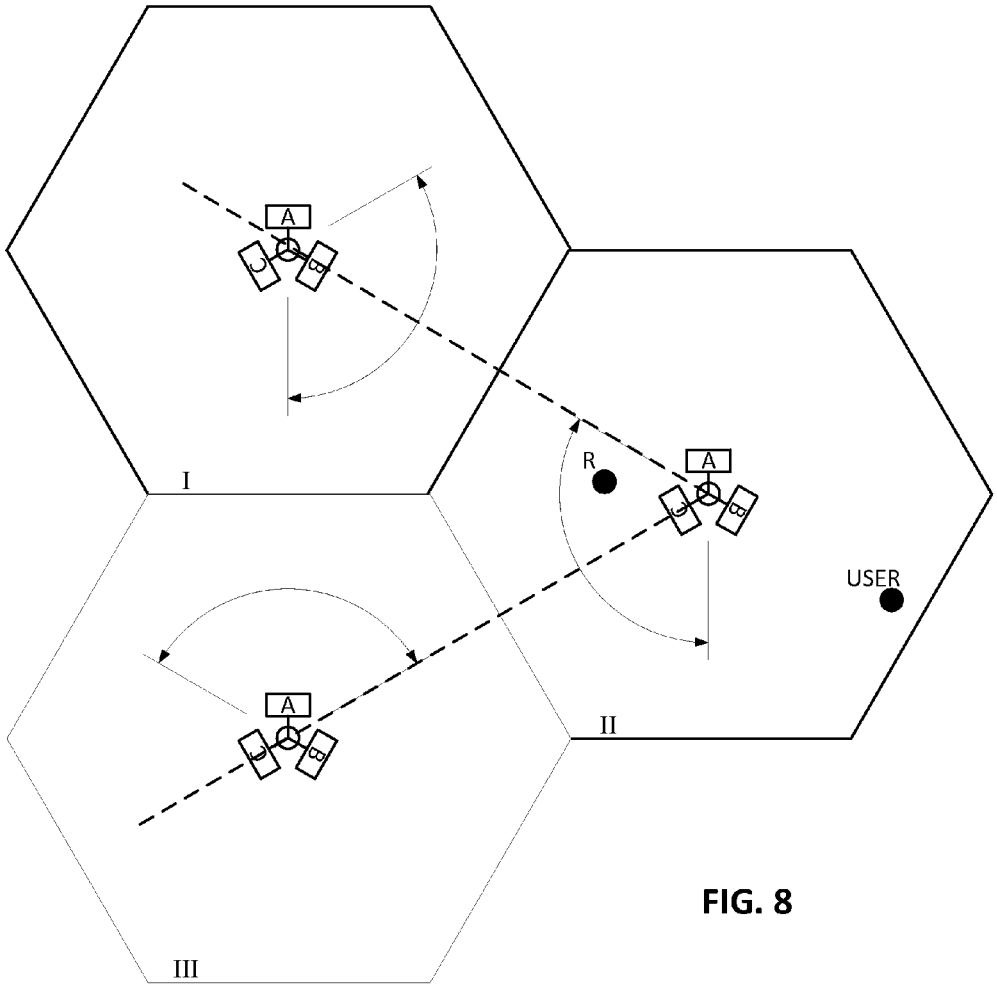
FIG. 8 shows how the location of a multipath reflector can be estimated through use of multiple stations.

In cellular networks, still additional information can be gathered from adjoining cell sites. Consider FIG. 8, which shows three cells, I, II and III—each with a cell tower in the center. A reflecting object R is shown in cell II. This object falls within the radiation pattern of antenna C in cell II. However, the object can be further localized by its placement within the radiation pattern of the cell towers for cells I and III. As shown, object R falls within the radiation pattern of antenna B in cell I, and antenna A in cell III. By sensing from which antenna at the different cell sites the multipath signal received as a consequence of the user's transmission is the strongest, these three antennas (I-B, II-C, III-A) can be identified. From this data, the location of the reflecting object may be localized to within a 60 degree arc from the tower in cell II (shown in dashed lines), rather than the 120 degree localization arc of FIG. 5. (Likewise for all the other towers.)

(Although only one cell tower is assigned to exchange data with a user phone, in actual practice the signals from one cell can often be sensed by receivers in adjoining cells.)

Still further improvements can be realized when multiple receivers (or transmitters) are used.

Figure 9:
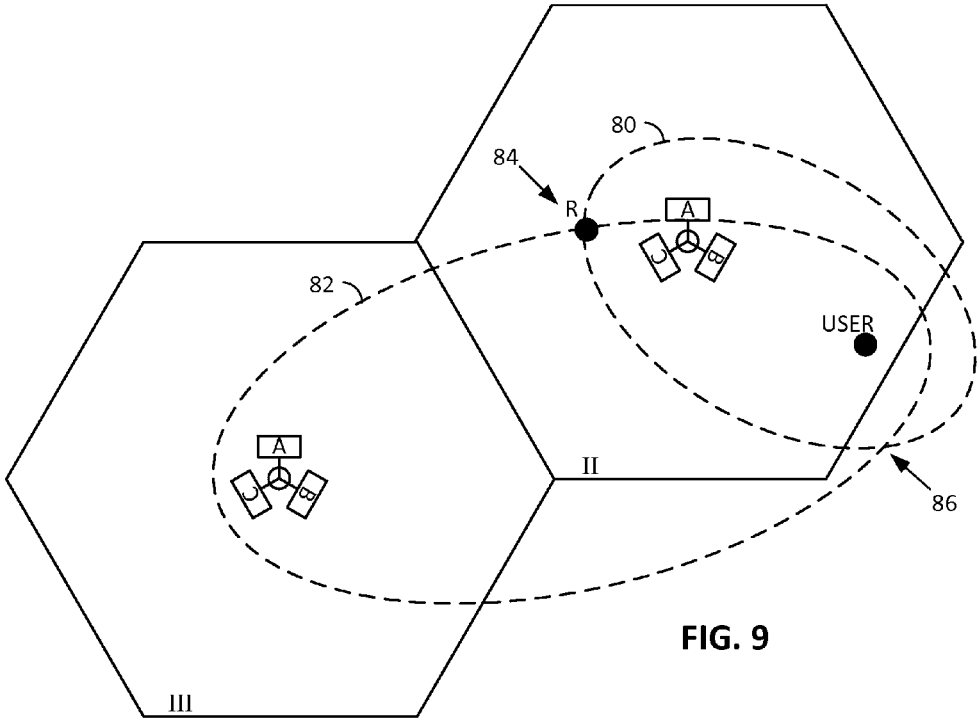
FIG. 9 shows how the location of a multipath reflector can be determined through use of multiple stations.

FIG. 9 shows an arrangement involving a user and a reflecting object "R." Both are within the coverage area of cell II, but their signals are also detectable by the tower in cell III.

The user and the cell tower in cell II are positioned at the foci of an ellipse 80, on which lies the reflecting object R.

The user and the cell tower in cell III are positioned at the foci of an ellipse 82. Again, reflecting object R lies on this ellipse.

The two ellipses intersect at points 84 and 86. The reflecting object must be located at one of these two intersection points. This ambiguity is resolved by reference to which of antennas A, B and C in cell site II most strongly (or weakly) picks up the multipath reflection from object R. In the illustrated case, the multipath reflection from object R is most weakly picked-up by antenna B, indicating that the reflecting object R is at point 84—since this point is in the region is most weakly picked-up by antenna B.

To review, by reference to the delays in reception of the multipath signal from object R, by receivers at cell sites II and III (relative to the time of reception of the direct signal from the user), the locations of ellipses 80 and 82 can be determined. The reflecting object is found at one of the two points where these ellipses intersect, which ambiguity is resolved by reference to signal strengths among the component antennas at cell site II.

(As before, a reciprocal arrangement can likewise be used, in which the user serves as the receiving station. In this case, the user receiver can analyze signals radiated by the two towers and the reflecting object R in determining location of that reflecting object.)

Figure 10:
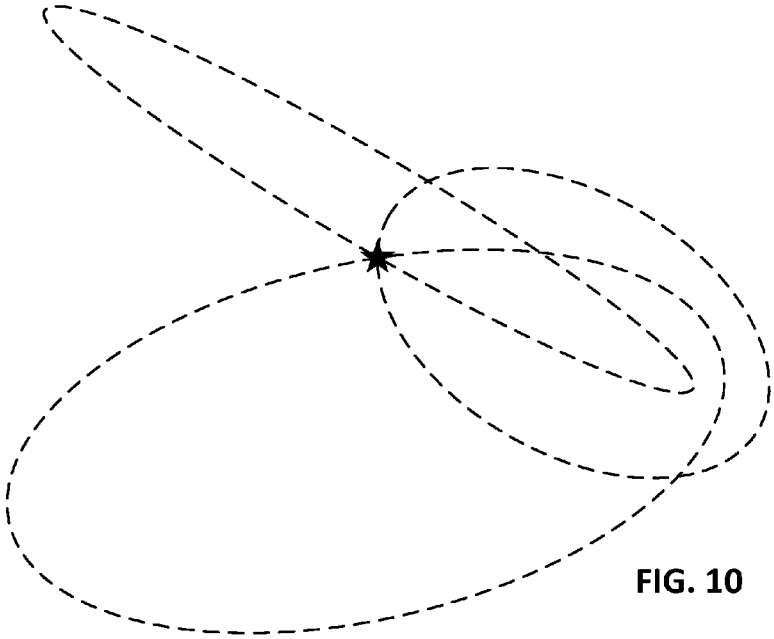
FIG. 10 shows how the arrangement of FIG. 9—if extended to include a third cell site—allows the location of a multipath reflector to be determined without reference to signal strength disambiguation techniques.

Naturally, these principles can be extended to involve still more stations, such as the cell tower in cell I (not shown in FIG. 9). In this case, three ellipses are involved. Still other scenarios can involve four or more ellipses. In arrangements involving three or more ellipses, the ellipses typically intersect at only a single point (e.g., as shown in FIG. 10), so the ambiguity-resolution step may be omitted.

Once the location of the reflecting object R has been determined, this information is added to the environmental multipath model, which may thereafter be used in applying multipath-corrective techniques.

In one particular arrangement, the environmental model includes a table or other data structure in which the location of each multipath reflector is specified (e.g., by latitude and longitude). The amplitude of signal reflected by the multipath reflector—from a given cell site transmitter tower, can also be sensed by the receiver and specified in the table, e.g., in relative terms, such as in decibels below the signal emitted from the transmitter tower. (Conventional square-law field strength analysis can be applied to relate multipath strength at a given distance from the reflector.) Alternatively or additionally, the magnitude of the multipath signal from a given reflector can be detailed at sample points throughout the geographic extent of the model, based on analyses (such as detailed above) involving user devices at those different locations.

Each multipath reflector may be assumed to radiate omnidirectionally in a horizontal plane, or the data structure can further include one or more parameters specifying or modeling the reflector's apparent directivity (as sampled based on measurements taken with user devices at different locations relative to the reflector).

Over the course of days and weeks, by involvement of user devices throughout the geographic area, a highly detailed model of multipath reflection is compiled, and is thereafter refined by on-going measurements. Some components of the model may be found to be highly persistent and repeatable (e.g., from large, immovable structures in the modeled area). Other components of the model may be highly variable (e.g., depending on different arrangements of cars in a parking lot). The data structure can assign a score to each multipath reflector, indicating its repeatability.

The environmental model developed through use of the foregoing techniques can be employed in myriad ways, which are generally beyond the scope of this disclosure. (Reference is made to the previous patent work.) However, a simple example will illustrate the point.

Consider a user at the RX location in FIG. 5, who receives both a direct signal from the cell site tower, as well as a multipath signal reflected from object R. The model may indicate that—at the RX location—the user can expect to receive a multipath signal that is delayed 2 microseconds relative to the direct-path signal, and is 18 dB weaker in signal strength. In this example, the user's receiver comprises a software-defined radio that converts the incoming RF signal (or a down-converted, intermediate frequency) into digital form. This stream of digital data is applied to a processing device (responsive to data in the model) that essentially takes the incoming signal, reduces it by 18 dB, and subtracts it from the incoming signal 2 microseconds later. Of course, this is a conceptual description, and in actual practice more sophisticated techniques will be used.

One such technique is adaptive filtering, which varies filtering parameters to minimize multipath artifacts in the received signal. Such filters are known in the prior art (see, e.g., U.S. Pat. Nos. 7,333,532, 7,599,426, 8,107,519, and 8,107,572), but these prior art arrangements do not have the benefit of an environmental model that provides a priori information about the multipath, e.g., indicating the number, amplitude, and/or delay timing of its components, by which the filter can be pre-tuned and configured for the expected conditions given the user's location.

Further Comments

In a gross sense, analyzing received multipath signals under circumstances of two different antenna directivities may be analogized to viewing a scene with two different cameras. The different circumstances allow discernment of additional information. With three or more different states of antenna(s) directivity, still more environmental information can be deduced.

While described in the context of cell phone systems, the same principles can be applied to WiFi systems. The directivity of WiFi access point antennas similarly can be steered from their default generally omnidirectional arrangement into differently-lobed patterns, transmitting different energy densities towards different multipath reflectors. And reciprocally, receiving different strengths of signals from these reflectors during reception.

Although not as widely applicable, the polarization sense of antenna(s) in the system may be changed (vertical/horizontal/clockwise-circular, CCW-circular) for still additional insight into the reflective environment.

While particularly described in the context of the previous patent work (e.g., in pre-processing received signals to reduce multipath before applying such signals to the processes detailed in such work), it should be recognized that the principles of the present technology are not so limited. Instead, they can be used in wireless communication systems of disparate types, to address a variety of issues.

Although the illustrative implementations employ three antennas spaced around a tower, the same principles can likewise be extended to different numbers of antennas. Similarly, while component antennas of fixed directivity were illustrated, in other embodiments one or more of the component antennas may themselves be electrically steerable, such as by active phased array techniques.

While the specification makes reference to signal strengths, this term encompasses a variety of other measurements that may also be applied. For example, the signal-tonoise ratio of a signal can be used in the described methods. Similarly, the bit error rate of data conveyed by a signal can be used as a proxy for its strength. That is, a higher error rate indicates a weaker signal. (Error correction encoding techniques, such as are commonly used in wireless data systems, can track the number of errors detected/corrected during decoding, giving a bit error rate.) Thus, the term "signal strength" should be construed herein as literally encompassing such alternative metrics.

As indicated, the signal strength information and/or other model data can be generated by different devices throughout the system, and compiled at any of those devices, or at other locations (or in the cloud). Periodically, information from the model can be distributed to other processing nodes (e.g., a user's cell phone) for use there.

The detailed arrangement involved a single cycle of different antenna excitations at the beginning of each minute. Such cycles can occur more or less often, such as every 10, 30, 120 or 600 seconds. In another example, a cycle of different excitation patterns can repeat continuously.

The artisan will recognize that the control unit of FIG. 6, and the other processing arrangements referenced herein, can comprise a hardware processor configured in accordance with software instructions and data stored in an associated memory. The software instructions cause the hardware processor to perform the acts detailed in this disclosure.

The power splitter of FIG. 6 can take various forms. It can be a three-way splitter that includes a resistive dump load into which power that would otherwise go into an idle antenna (i.e., momentarily disconnected) goes. In such arrangement, the power provided to each active antenna is the same regardless of whether one antenna is disconnected, or none is disconnected. Alternatively, switching circuitry can be employed to substitute a two-way splitter during the time periods that only two of the three antennas are being used. In this case, the power provided to each of the two active antennas is increased by 50%, compared to when all three antennas are being driven (at which time a three-way splitter is restored to the circuit).

While reference has been made to methods involving adjoining cell sites, the same principles can be used wherever there are multiple stations. WiFi networks, for example, commonly have multiple access points.

Having described and illustrated the principles of the technology with reference to specific implementations, it will be recognized that the technology can be implemented in many other, different, forms. To provide a comprehensive disclosure without unduly lengthening the specification, applicant incorporates by reference the patents and patent applications referenced above, in their entireties.

The methods, processes, and systems described above may be implemented in hardware, software or a combination of hardware and software. For example, the processes may be implemented in a programmable computer or a special purpose digital circuit. Similarly, they may be implemented in software, firmware, hardware, or combinations of software, firmware and hardware. The methods described above may be implemented in programs executed from a system's memory (a computer readable medium, such as an electronic, optical or magnetic storage device).

The particular combinations of elements and features in the above-detailed embodiments are exemplary only; the interchanging and substitution of these teachings with other teachings in this and the incorporated-by-reference patents/applications are also contemplated.

I claim:

1. A method of generating a model of a wireless multipath environment, the method intermittently modifying operation of a cellular telephone system during normal service, the cellular telephone system including first and second cellular telephone stations, each cellular telephone station including an antenna array comprising N radiators equi-angularly spaced around a vertical pole, the method comprising the acts:

(a) during normal service of said cellular telephone system, temporarily changing a distribution of power among the N radiators of said first station from a normal state to a different state, wherein in the normal state all N of the radiators are equally-powered, and in the different state, one of said N radiators receives more or less power than the other radiators;

(b) from a signal strength change between said normal and different states, of signals exchanged between the first cellular telephone station and a mobile terminal, determining an angular region extending from the vertical pole of the first cellular telephone station in which a multipath reflector is positioned;

(c) during normal service of said cellular telephone system, temporarily changing a distribution of power among the N radiators of said second station from a normal state to a different state, wherein in the normal state all N of the radiators are equally-powered, and in the different state, one of said N radiators receives more or less power than the other radiators;

(d) from a signal strength change between said normal and different states, of signals exchanged between the second cellular telephone station and said mobile terminal, determining an angular region extending from the vertical pole of the second cellular telephone station in which said multipath reflector is positioned;

(e) localizing a position of the multipath reflector based on overlap of the angular regions extending from the vertical poles of the first and second cellular telephone stations, and entering resultant position data in a data structure; and repeating acts (a) through (e) multiple times during regular service of said cellular telephone system;

wherein a dynamically-updated model of multipath reflectors is created and updated during regular service of the cellular telephone system.

2. The method of claim 1 that further includes:

determining, from a time delay of a multipath component of a signal transferred between the first station and said mobile terminal, a first spatial ellipse on which said multipath reflector is positioned;

determining, from a time delay of a multipath component of a signal transferred between the second station and said mobile terminal, a second spatial ellipse on which said multipath reflector is positioned;

determining, from overlaps of said first and second spatial ellipses, two candidate points at which said multipath reflector may be positioned;

from said signal strength change between said normal and different states, of signals exchanged between the first station and said mobile terminal, identifying one of said two candidate points as a resolved position of said multipath reflector; and entering data indicating said resolved position of the multipath reflector in said data structure.

3. The method of claim 2 that further includes:

modeling distortion of an original signal sent from the first station, as received by the mobile terminal, taking into account superposition of a delayed component due to said multipath reflector; and at the mobile terminal, applying a filtering operation to counteract said modeled distortion.

4. The method of claim 2 that further includes:

modeling distortion of an original signal sent from the mobile terminal, as received by the first station, taking into account superposition of a delayed component due to said multipath reflector; and at the first station, applying a filtering operation to counteract said modeled distortion.

5. The method of claim 1 that further includes a third cellular telephone station, including an antenna array comprising N radiators equi-angularly spaced around a vertical pole, the method further comprising:

during normal service of said cellular telephone system, changing a distribution of power among the N radiators of the third cellular telephone station from a normal state to a different state, wherein in the normal state all N of the radiators are equally-powered, and in the different state, one of said N radiators receives more or less power than the other radiators;

from a signal strength change between said normal and different states, of signals exchanged between the third station and said mobile terminal, determining an angular region extending from the vertical pole of the third station in which said multipath reflector is positioned; and localizing the position of the multipath reflector based on overlap of the angular regions extending from the vertical poles of the first, second and third cellular telephone stations, and entering resultant position data in the data structure.

6. The method of claim 5 that further includes:

determining, from a time delay of a multipath component of a signal transferred between the first station and said mobile terminal, a first spatial ellipse on which said multipath reflector is positioned;

determining, from a time delay of a multipath component of a signal transferred between the second station and said mobile terminal, a second spatial ellipse on which said multipath reflector is positioned;

determining, from a time delay of a multipath component of a signal transferred between the third station and said mobile terminal, a third spatial ellipse on which said multipath reflector is positioned;

determining, from overlaps of said first, second and third spatial ellipses, an unambiguous position of said multipath reflector; and entering data indicating said unambiguous position of the multipath reflector in said data structure.

7. The method of claim 1 that further includes a third cellular telephone station, including an antenna array comprising N radiators equi-angularly spaced around a vertical pole, the method further comprising:

determining, from a time delay of a multipath component of a signal transferred between the first station and said mobile terminal, a first spatial ellipse on which said multipath reflector is positioned;

determining, from a time delay of a multipath component of a signal transferred between the second station and said mobile terminal, a second spatial ellipse on which said multipath reflector is positioned;

determining, from a time delay of a multipath component of a signal transferred between the third station and said mobile terminal, a third spatial ellipse on which said multipath reflector is positioned;

determining, from overlaps of said first, second and third spatial ellipses, an unambiguous position of said multipath reflector; and entering data indicating said unambiguous position of the multipath reflector in said data structure.

8. The method of claim 7 that further includes:

modeling distortion of an original signal sent from the first station, as received by the mobile terminal, taking into account superposition of a delayed component due to said multipath reflector; and at the mobile terminal, applying a filtering operation to counteract said modeled distortion.

9. The method of claim 7 that further includes:

modeling distortion of an original signal sent from the mobile terminal, as received by the first station, taking into account superposition of a delayed component due to said multipath reflector; and at the first station, applying a filtering operation to counteract said modeled distortion.

* * * * *